US006997143B2

(12) United States Patent
Piccirilli et al.

(10) Patent No.: US 6,997,143 B2
(45) Date of Patent: Feb. 14, 2006

(54) INTEGRATED HEAT EXCHANGE AND FLUID CONTROL DEVICE

(75) Inventors: Davide Fausto Piccirilli, Livonia, MI (US); John William Myers, Howell, MI (US); David C. Letteer, Brighton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 131 days.

(21) Appl. No.: 10/734,833

(22) Filed: Dec. 12, 2003

(65) Prior Publication Data

US 2005/0126517 A1 Jun. 16, 2005

(51) Int. Cl.
*F02M 57/06* (2006.01)

(52) U.S. Cl. ..... 123/41.1; 165/297

(58) Field of Classification Search ..... 123/41.1; 165/41, 103, 297, DIG. 110
See application file for complete search history.

(56) References Cited

U.S. PATENT DOCUMENTS

| | | | | |
|---|---|---|---|---|
| 1,578,805 | A | 3/1926 | Cooper | |
| 1,865,877 | A | 7/1932 | Mougey et al. | |
| 3,034,770 | A * | 5/1962 | Hiersch | 165/103 |
| 4,432,410 | A | 2/1984 | Cadars | |
| 5,111,775 | A | 5/1992 | Sumida et al. | |
| 5,305,826 | A | 4/1994 | Couëtoux | |
| 5,950,715 | A | 9/1999 | Jönsson et al. | |
| 6,164,248 | A | 12/2000 | Lehmann | |
| 6,471,133 | B1 | 10/2002 | O'Flynn et al. | |
| 6,539,899 | B1 | 4/2003 | Piccirilli et al. | |
| 2003/0209344 | A1 * | 11/2003 | Fang et al. | 165/140 |

* cited by examiner

*Primary Examiner*—Noah P. Kamen
(74) *Attorney, Agent, or Firm*—Brinks Hofer Gilson & Lione

(57) ABSTRACT

An integrated heat exchange and fluid control device is provided having an inlet, a valve, a heat exchange section in fluid connection with the valve, a bypass section in fluid connection with the valve, and an outlet section in fluid communication with the bypass section and the heat exchange section. The valve is configured to distribute flow of the coolant into the heat exchange system and/or the bypass section. In the heat exchange sections, coolant is substantially cooled by a second fluid or airflow. In the bypass section, the coolant is substantially prevented from being cooled by the second fluid or airflow.

16 Claims, 6 Drawing Sheets

INTEGRATED HEAT EXCHANGE AND FLUID CONTROL DEVICE

BACKGROUND OF THE INVENTION

This invention relates generally to a device for controlling the temperature of fluid in a closed-circuit system. More specifically, the invention relates to an integrated heat exchange and fluid control device for an engine, such as an automobile engine.

Automobile engines optimally operate in a known temperature range. Typically, an automobile's engine temperature is below this optimal range during engine warm-up. It is therefore desirable to cause the engine to reach its optimal temperature range as quickly as possible by not cooling the engine fluid immediately after warm-up. However, engines will eventually reach temperatures above this optimal range if left uncooled, so it is thereafter desirable to cool the engine fluid so the engine does not exceed the maximum optimal operating temperature, and is controlled within the optimal temperature range.

Additionally, engine fluid temperature control systems are typically closed-circuit systems with a constant fluid volume. Therefore, it is desirable for a fluid temperature control device to be able to quickly and accurately adjust the amount of fluid that is cooled without adjusting the overall fluid volume in the system.

Fluid temperature control devices typically control the operating temperature of engine fluid by using a bypass loop, such as a bypass circuit, that directs fluid away from the heat exchanger. Presently, bypass circuits are located, externally from the heat exchanger, either internally or externally to the engine, in order to minimize heat transfer of the fluid in the bypass circuit. However, an external fluid bypass circuit requires added components such as additional seals, housing structures, and tubing. External bypass circuits also cause unnecessary complexities during system diagnosis and repair because the system components are dispersed throughout the internal structure of the engine. Additionally, traditional bypass circuits can reduce the efficiency of cooling system fluid fill and fluid evacuation during manufacturing and during repair.

BRIEF SUMMARY OF THE INVENTION

The current invention provides the integration of a heat exchange device and a fluid control device. The fluid control device permits temperature control of the fluid flowing through a system by diverting the fluid flow into different conduits, a heat transfer conduit and a bypass conduit. The different conduits effectuate different degrees of heat transfer to control the overall temperature of the fluid passed to the engine. In order to more effectively prevent heat transfer of fluid in the bypass conduit, thereby giving the system more control over the temperature of the fluid, the bypass conduit may be adjacent to a static blocking shield; it may be adjacent to a dynamic blocking shield; it may have a larger cross-sectional area than the heat transfer conduits; or it may have other appropriate modifications. Additionally, the invention may include a device or devices, such as baffle(s), used to maintain separation of the fluids after they have been diverted into different conduits.

In order to divert the fluid into the conduits, the invention preferably incorporates a valve assembly and a control system for the valve assembly. The valve assembly may also be able to divert fluid into a secondary circuit, such as a heater circuit. The control system preferably includes an input device for measuring a system parameter, such as fluid temperature; and also includes an output device for controlling the position of the valve assembly. The control system may include an automated control system and/or a manual control system.

The integration of the heat exchange device and the fluid control device provides fluid temperature control, while enabling reduction of the complexity in the system external to the integrated devices, improving ease of access to the integrated device after installation, and improving fluid control response time.

DETAILED DESCRIPTION OF THE INVENTION

Figure 1:
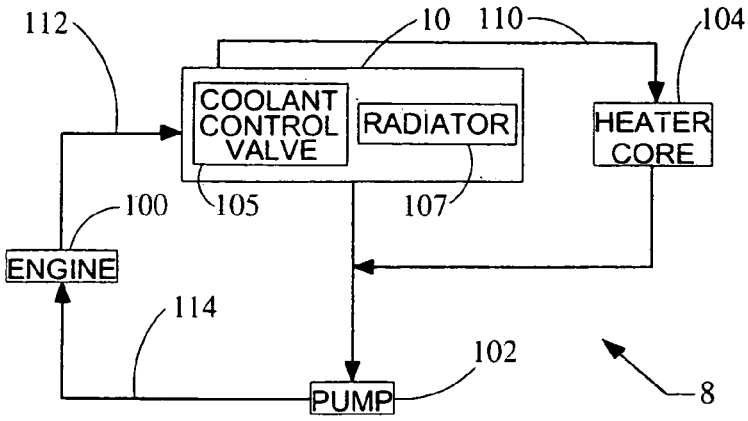
FIG. 1 is a block diagram showing coolant flow through an engine circuit including an integrated radiator and coolant control device of the present invention.
Figure 2:
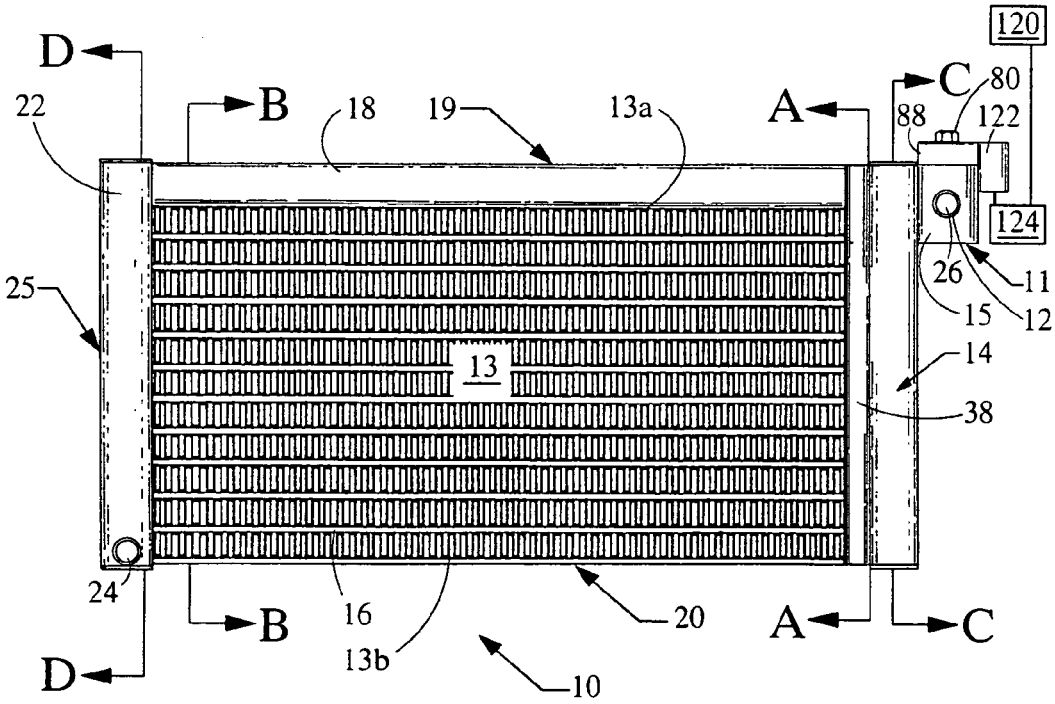
FIG. 2 is a plan view of the rear face of an integrated heat exchange and fluid control device of the present invention.

Referring to FIGS. 1 and 2, one application of the present invention is in an engine cooling circuit 8, where a cooling fluid flows from a pump 102 into an engine 100 along a line 114. The fluid is preferably a common liquid coolant 21 (designated in FIG. 3A) such as ethylene glycol, but other appropriate fluids may be used. In the engine 100, the liquid coolant 21 typically absorbs energy and therefore becomes heated. From the engine 100, the liquid coolant 21 next flows through a line 112 to the integrated heat exchange and fluid control (integrated radiator) assembly 10 which includes a coolant control valve 105 and a radiator 107. Once entering the integrated radiator 10, all, none, or some of the liquid coolant 21 flows into the heat exchange section 20 to undergo substantial heat transfer and all, none, or some of the liquid coolant 21 flows into a bypass section 19 and undergoes substantially no heat transfer. Some of the liquid coolant 21 may be diverted away from the integrated radiator assembly 10 to an optional heater core 104 along circuit heater to heat the air passing into the passenger compartment of the vehicle. From the integrated radiator assembly 10 and/or heater core 104, the liquid coolant 21 flows back into the pump 102 and the cycle repeats. The current invention is preferably used in a closed-circuit cycle, as shown in FIG. 1.

One embodiment of the integrated radiator assembly 10 is shown in FIG. 2. This embodiment includes a radiator core 13 having the bypass section 19 and the heat exchange section 20 mentioned above. The integrated radiator assembly 10 further includes an inlet tank 14 and an outlet tank 22 located on opposing sides of the radiator core 13 and in fluid communication therewith. To provide coolant 21 to the inlet tank 14, an inlet section 15 for receiving liquid coolant 21 from the engine 100 via line 112 is coupled via an inlet connector 12. As further discussed below, the inlet section 15 is configured to divert the coolant 21 as required to the various sections of the radiator core 13 (as briefly discussed above). In other words, the inlet section 15 is configured to control the volume of coolant flow through the bypass section 19 (the bypass flow 21*a*) and the heat exchange section 20 (the heat exchange flow 21*b*). After passing through the radiator core 13, the coolant 21 is received in the outlet tank 22 and discharged via outlet 24 back to the pump 102.

The details of the inlet section 15 will first be discussed.

Figure 4A:
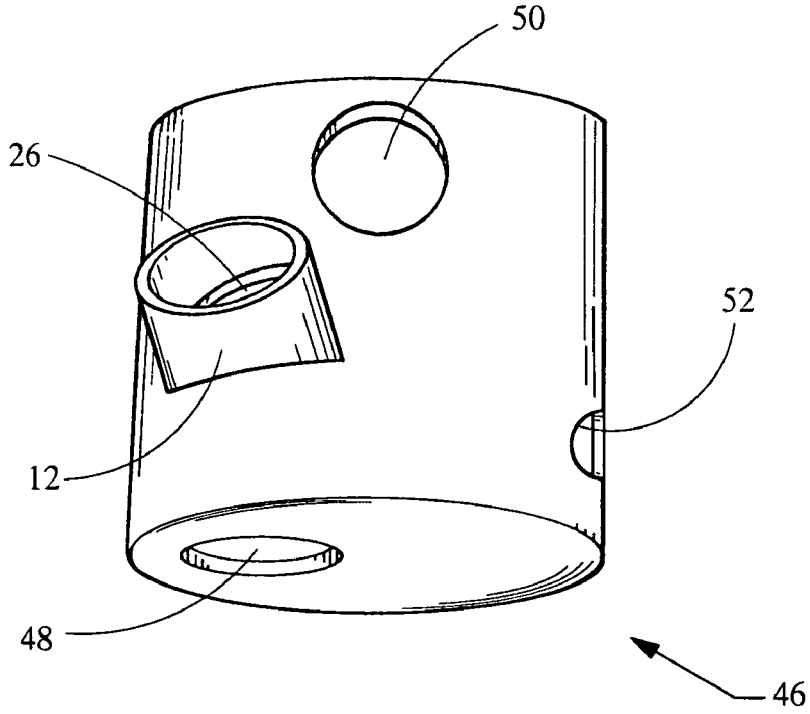
FIG. 4A is a perspective view of the inlet body of the coolant control device in the present invention.

As shown in FIG. 4A, the inlet section 15 preferably includes an inlet body 46 for receiving a rotatable element 64. The inlet body 46 includes an inlet port 26 that receives fluid from the inlet connector 12 and first and second ports 48 and 50. The first port 48 is a heat exchange port in fluid communication with the heat exchange conduits 16, and the second port 50 is a bypass port in fluid communication with the bypass conduit 18. In an alternative construction, the inlet body 46 may include a third port 52, which is a heater port in fluid communication with a heater core 104.

Figure 4B:
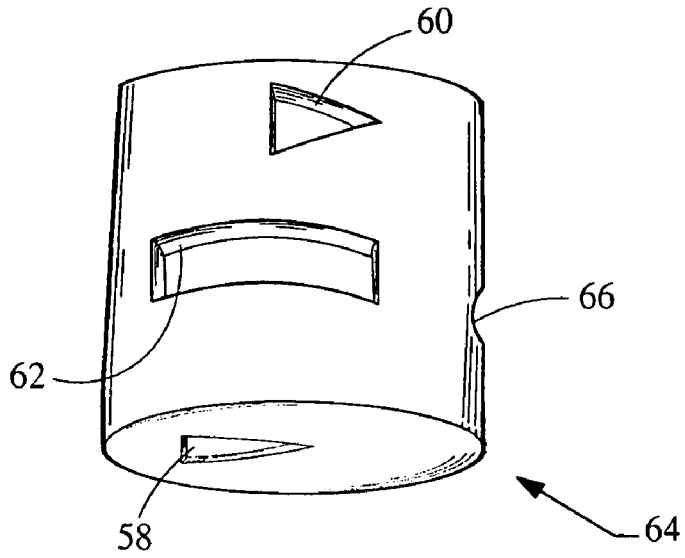
FIG. 4B is a perspective view of the rotatable element of the coolant control device in the present invention.
Figure 4C:
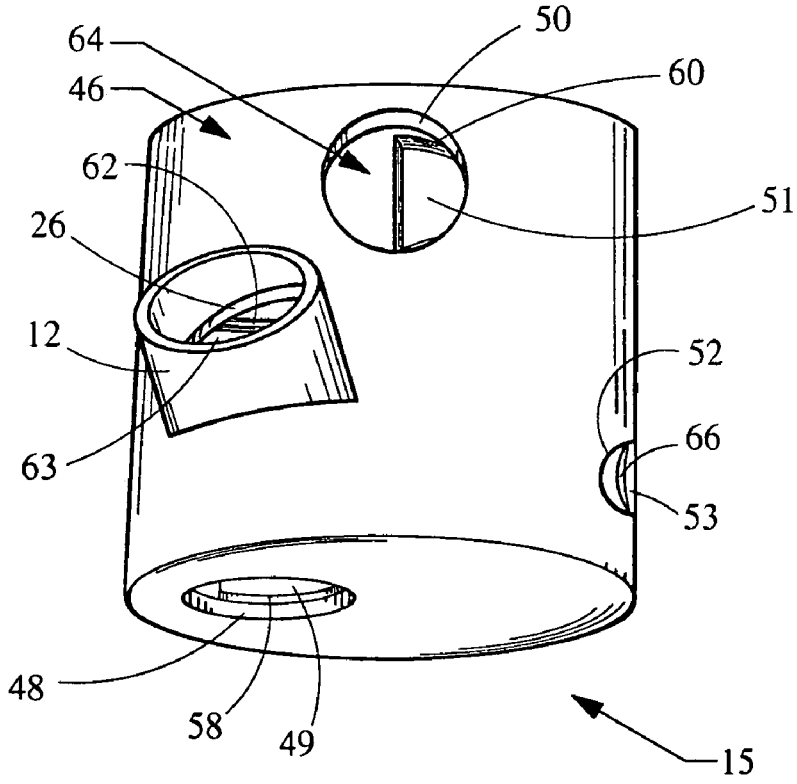
FIG. 4C is a perspective view of the inlet body of FIG. 4A assembled with the rotatable element of FIG. 4B.
Figure 5:
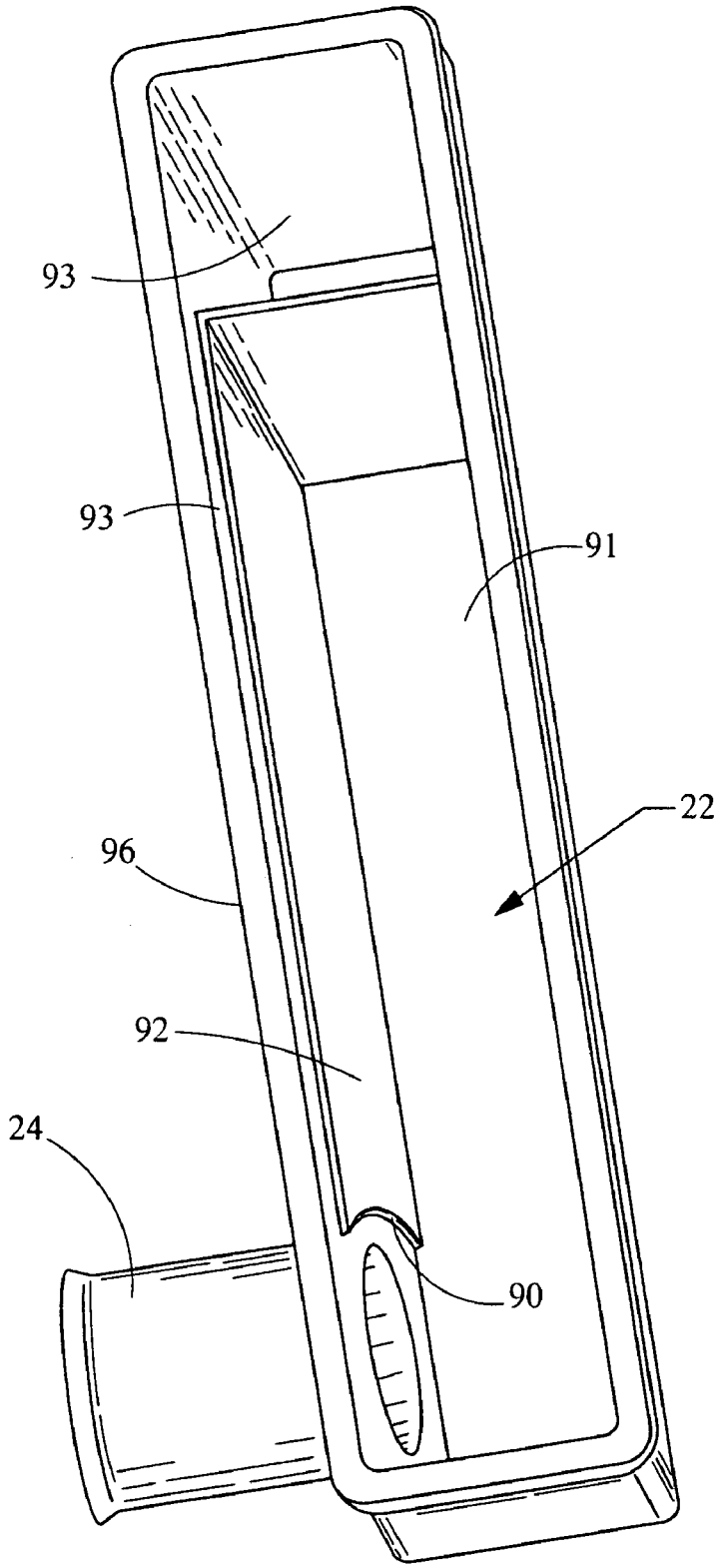
FIG. 5 is a cross-sectional view of the outlet tank, generally taken along the line D—D in FIG. 2.

As shown in FIG. 4B, the rotatable element 64 includes an inlet 62, a first opening 58 for connecting with the heat exchange section 20, and a second opening 60 for connecting with the bypass section 19. The rotatable element 64 may also include a third opening 66 for connecting to the heat circuit 110.

The inlet 62 of the rotatable element 64 is positioned with respect to the inlet port 26 of the inlet body 46 so as to form an inlet opening 63. The inlet opening 63 may be a variable opening of varying size and/or shape as the rotatable element 64 rotates relative to the inlet body 46. Alternatively, the inlet opening 63 may be a fixed opening, with a constant size regardless of the rotatable element 64 position.

The three openings 58, 60, and 66 of the rotatable element 64 are positioned with respect to the three ports 48, 50, and 52 of the inlet body 46 so as to be able to be moved into partially or fully overlapping positions and form variable openings 49, 51, and 53 of varying size and/or shape as the rotatable element 64 rotates relative to the inlet body 46. Accordingly, the first variable opening 49 is defined by the first port 48 and the first opening 58, and it fluidly connects the inlet section 15 with the heat exchange section 20. The second variable opening 51 is defined by the second port 50 and the second opening 60, and it fluidly connects the inlet section 15 with the bypass section 19. The optional third variable opening 53 is defined by the third port 52 and the third opening 66, and it fluidly connects the inlet section 15 with the heater circuit 110. Alternatively, any of these three aforementioned variable openings 49, 51, and 53 may be configured so as to have a constant cross-sectional area as the rotatable element 64 rotates relative to the inlet body 46. In a preferred embodiment, some or all of the variable openings 49, 51, and 53 may also be closed in certain orientations of the rotatable element 64 relative to the inlet body 46, preventing all fluid from flowing through any of the openings 49, 51, and 53.

The rotatable element 64 is preferably controlled by an automated control mechanism, such as the motor 122 shown in FIG. 2. A sensor 120, preferably located between the engine 100 and the integrated radiator assembly 10, measures a system parameter, such as the temperature of the liquid coolant 21 or the temperature of an engine cylinder head (not shown). A controller 124 compares the measured system parameter with an optimal system parameter and generates an error value. The controller 124, then activates the motor 122 in response to the error value, and the motor 122 rotates the rotatable element 64. An assembly cap 88 is received onto input section 15 and covers the rotatable element 64.

The rotatable element 64 may also be controlled by a manual control mechanism, such as a torque member 80. The torque member 80 is connected to the rotatable element 64 and it extends through the top of the assembly cap 88. The torque member 80 is configured to receive a rotational torque force from a tool such as a torque wrench (not shown), causing the rotatable element 64 to rotate. The torque member 80 preferably has a hexagon-shaped cross-section in order to receive the torque wrench. The torque member 80 permits manual adjustment of the rotatable element 64 during operation, assembly, and service.

A valve actuator (not shown), such as a spring mechanism, causes the rotatable element 64 to automatically rotate to a design position whenever there is a loss of power or loss of communication with the sensor 120. The design position is preferably the position where the variable openings 49, 51, 53, and 63 have maximized cross-sectional areas respectively. Such a design position is advantageous during operation because it provides a level of functionality during a system failure and because it allows the engine system 8 to be filled with liquid coolant 21 quickly during assembly and service fill operations.

Once the liquid coolant 21 travels through one of the first and second variable openings 49 and 51, it flows into the inlet tank 14. Alternatively, the flow is directed into the heater circuit 110.

A baffle 70 separates the inlet tank 14 into an upper inlet tank section 28 and a lower inlet tank section 29, which are respectively coupled to the bypass flow opening 74 and the radiator flow opening 72 which prevent mixing between the bypass fluid flow 21*a* and the heat exchange fluid flow 21*b*.

Figure 3A:
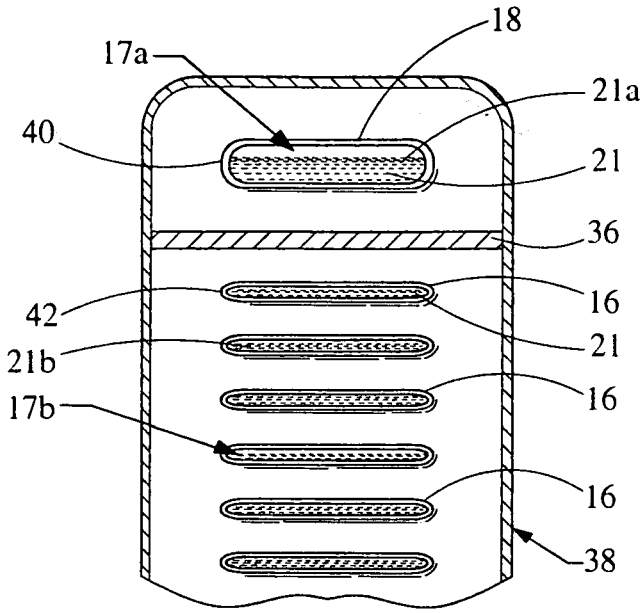
FIG. 3A is a cross-sectional view of a header of the device, generally taken along the line A—A in FIG. 2.

The inlet tank 14 mates with a header 38 (seen in FIG. 1) that provides a fluid connection between the inlet tank 14 and the heat exchange conduits 16 and the bypass conduit 18. A gasket, adhesive, or metal bond provided between the inlet tank 14 and header 38 forms a fluid tight seal between the two components. As shown in FIG. 3A, the bypass conduit 18 and the heat exchange conduits 16 are connected to openings 42 and 40 in the header 38 at one end of the conduits 16, 18. Similar to the inlet tank 14 and corresponding thereto, a baffle seat 36 is provided in a corresponding position to the baffle 70 and prevents the mixture of fluid bypass flow 21*a* with the heat exchange fluid flow 21*b*.

The heat transfer conduits 16 of the heat exchange section 20 are exposed to airflow 32 perpendicular to the direction through the conduits 16. In this type of heat exchanger, the airflow 32 is preferably cooler than the heat exchange fluid flow 21*b*, causing the heat exchange fluid flow 21*b* to be cooled by the airflow 32. The heat exchange fluid flow 21*b* preferably undergoes a substantial heat transfer process with the airflow 32 such that the airflow 32 substantially cools the heat exchange fluid flow 21*b*.

The bypass conduit 18 is preferably located along either the top 13*a* or the bottom 13*b* of the radiator core 13. However, the bypass conduit 18 may be located in other appropriate configurations. Preferably, the bypass conduit 18 is a conduit with a cross-sectional area 17*a* equal to or greater than the cross-sectional area 17*b* of the heat exchange conduits 16 in order to minimize pressure drop across the bypass conduit 18. However, the bypass conduit 18 may be any other suitable size. For ease of manufacturing, it may be advantageous to use a conduit with the same dimensions as the heat exchange conduits 16. Also, it may be advantageous to include a plurality of conduits to serve as bypass conduits, with the number of conduits dependent on the cross-sectional area and the fluid flow capacity requirements of coolant system 8.

Figure 3B:
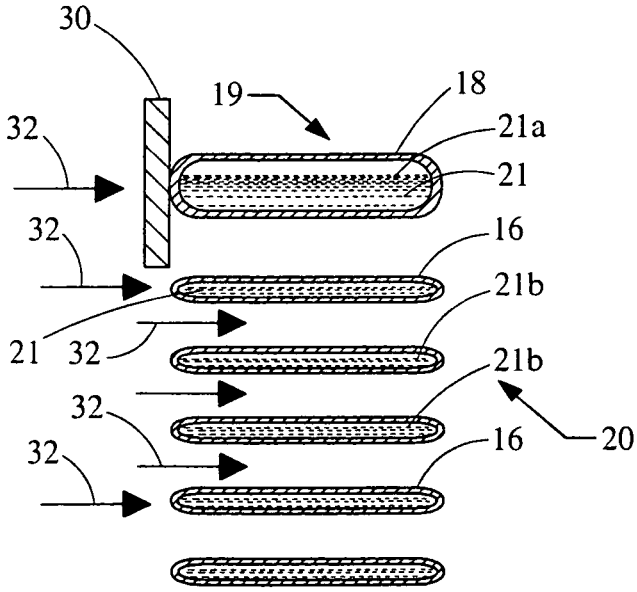
FIG. 3B is a partial cut view of the bypass conduit and heat exchange conduits, generally taken along the line B—B in FIG. 2.
Figure 3C:
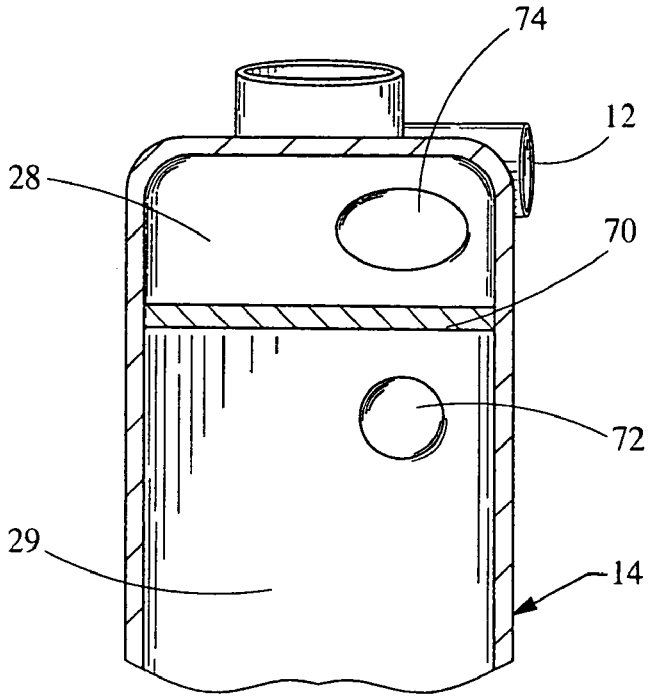
FIG. 3C is a partial cross-sectional view of the inlet tank, generally taken along the line C—C in FIG. 2.

The bypass fluid flow 21*a* is not intended to undergo a substantial heat transfer process, and thus the temperature of the bypass flow 21*a* stays relatively constant as it flows through the integrated radiator 10. To achieve this, a blocking shield 30 is preferably coupled with the bypass conduit 18 and positioned with respect to the airflow 32 to substantially limit or prevent heat transfer between the bypass fluid flow 21*a* and the airflow 32. In an airflow-type heat exchanger, as shown in FIG. 3B, the blocking shield 30 is positioned with respect to the bypass conduit 18 to substantially block airflow 32 around the bypass conduits 18 and this substantially prevents heat transfer between the bypass fluid 21*a* and the airflow 32. The blocking shield 30 is especially advantageous where the bypass conduit 18 includes fins (not shown) to add structural support to the bypass conduit 18.

Figure 6:
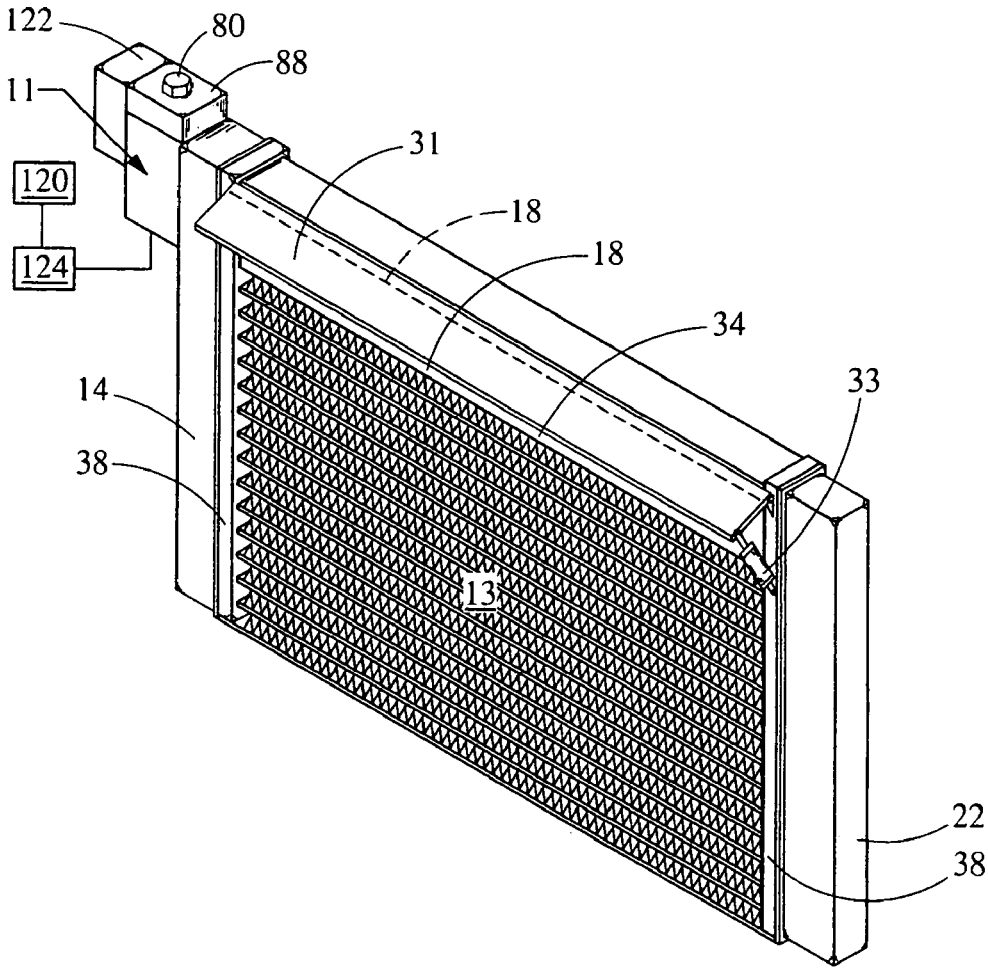
FIG. 6 is a perspective view showing the front face of an integrated radiator and coolant control device of the present invention that includes a dynamic blocking shield.

In another embodiment of the present invention, as shown in FIG. 6, a dynamic blocking shield 31, such as a pivotable blocking shield, is coupled with the bypass conduits 18 such as to control the exposure of the bypass conduit 18 to the airflow 32. In this embodiment, the bypass conduit 18 will permit a degree of heat transfer between the bypass fluid flow 21*a* and the airflow 32, depending on the position of the dynamic blocking shield 31. The angle of the dynamic blocking shield 31 is preferably controlled by a control system (not shown) that measures a system parameter such as fluid temperature and adjusts the angle of the dynamic blocking shield 31 in response to the measurement. The control system may include the sensor 120 mentioned above or it may include an additional sensor (not shown). A dynamic mechanism, such as an actuator 33, controls the position of the dynamic blocking shield 31.

Both the heat exchange conduits 16 and the bypass conduit 18 are connected to an outlet section 25 such that bypass fluid flow 21*a* and the heat exchange fluid flow 21*b* flow into the outlet section 25 from the respective conduits 16, 18. As shown, the outlet section 25 preferably includes an outlet tank 22 for receiving the liquid coolant 21 and an outlet 24 for dispensing the liquid coolant 21 from the outlet tank 22. The outlet tank 22 preferably includes outlet baffles 92 that keep separate the bypass flow 21*a* from the heat exchange flow 21*b*. The outlet baffles 92 are preferably located along the top and/or side 96 of the outlet tank 22 in order to substantially separate the outlet tank 22 into a first section 91, which is coupled with the heat exchange conduits 16, and a second section 93, which is coupled with the bypass conduit 18, in order to minimize mixing between the bypass flow 21*a* and the heat exchange flow 21*b* until the fluid flowing through the bypass section 19 flows past the outlet baffle edge 90 and reaches the outlet 24.

In another embodiment of the present invention, not shown, the airflow is replaced with a second liquid and the heat exchange section may include parallel plates forming a plurality of conduits for the second liquid. The conduits are adjacent to each other and separated by the plates such that the flowing liquids undergo heat exchange through the plates. A blocking shield in this embodiment is preferably located proximal to an appropriate plate defining a conduit in order to insulate the plate and minimize the heat exchange through the plate. Another embodiment of this invention is a dynamic blocking shield capable of adjusting the area of a conduit that is insulated from the other shield.

In another embodiment of the present invention, not shown, the coolant control valve 105 is located proximal to the outlet tank 22. In this embodiment, the coolant control valve 105 controls the volume of liquid coolant 21 flowing through the bypass section 19 and through the heat exchange section 18 by controlling the amount of liquid coolant 21 exiting the respective sections 18, 19. More specifically, the bypass conduit 18 and the heat exchange conduits 16 will become saturated with liquid coolant 21, and liquid coolant 21 at the inlet section 15 will be unable to enter the bypass conduit 18 and the heat exchange conduits 16 until the coolant control valve 105 permits the liquid coolant 21 to flow into the outlet tank 22.

The foregoing disclosure is the best mode devised by the inventors for practicing the invention. Inasmuch as the foregoing disclosure is intended to enable one skilled in the pertinent art to practice the instant invention, it should not be construed to be limited thereby but rather should be construed to include such aforementioned obvious variations and be limited only by the spirit and scope of the following claims.

What is claimed is:

1. An integrated heat exchange and fluid control device comprising:

an inlet section configured to permit entry of a first fluid into said integrated heat exchange and fluid control device, said inlet section including an inlet body and a rotatable element rotationally received in said inlet body; said inlet body including a first port and a second port and said rotatable element including a first opening and a second opening;

a core having a heat exchange section and a bypass section;

said heat exchange section being in fluid communication with said first port and configured to receive the first fluid and to permit substantial head exchange between said first fluid located in said heat exchange section and a second fluid, said heat exchange section including a plurality of substantially parallel heat exchange conduits through which the first fluid flows;

said bypass section being in fluid communication with said second port and configured to receive the first fluid and to substantially prevent heat exchange between the first fluid located in said bypass section and the second fluid, said bypass section including at least one bypass conduit located proximal to and substantially parallel with said heat exchange conduits; and an outlet tank coupled to both said heat exchange conduits and said bypass conduit configured to receive the first fluid therefrom and configured to discharge the first fluid from the integrated heat exchange and fluid control device;

wherein said first and second ports and openings are positioned relative to one another and cooperate to create a first variable opening between said first port and said first opening and a second variable opening between said second port and said second opening upon rotation of said rotatable element relative to said inlet body.

2. The integrated heat exchange and fluid control device of claim 1, further comprising a third port defined in said inlet body arid a third opening defining in said rotatable element, said third port and opening cooperating to define a third variable opening.

3. The integrated heat exchange and fluid control device of claim 2, said third variable opening being in fluid communication with an air heating system.

4. The integrated heat exchange and fluid control device of claim 1 further comprising a control mechanism including:

a sensor measuring engine temperature; and a response mechanism configured to rotate said rotatable element and adjust said variable openings in response to the engine temperature.

5. The integrated heat exchange and fluid control device of claim 4, further comprising a failsafe mechanism coupled to said rotatable element and, in response to at least partial failure of said control mechanism, configured to rotate said rotatable element to a design position, such that said first variable opening has a substantially equal cross-sectional area as said first port and said second variable opening has a substantially equal cross-sectional area as said second port.

6. The integrated heat exchange and fluid control device of claim 1, wherein said at least one bypass conduit has a cross-sectional area substantially larger than a cross-sectional area of said heat exchange conduits.

7. The integrated heat exchange and fluid control device of claim 1, said outlet tank includes a partition therein substantially preventing mixture of the first fluid received from said bypass section and the first fluid received from said heat exchange section.

8. The integrated heat exchange and fluid control device of claim 1, wherein said bypass section is positioned along a top side of the heat exchange section.

9. The integrated heat exchange and fluid control device of claim 1, further including a torque member coupled with and configured to rotate said rotatable element, said torque member extending away from said inlet section.

10. An integrated heat exchange and fluid control device comprising:

an inlet section configured to receive a first fluid into said integrated heat exchange and fluid control device;

a heat exchange section in fluid communication with said inlet section and configured to receive a portion of the first fluid, said heat exchange section including a plurality of substantially parallel heat exchange conduits;

a bypass section in fluid communication with said inlet section and configured to receive a portion of the first fluid and to substantially prevent heat exchange between the first fluid located in said bypass section and a second fluid, said bypass section including:

at least one bypass conduit located proximal to and substantially parallel with said heat exchange conduits, and at least one blocking shield connected to said bypass section and positioned so as to obstruct airflow across said bypass section; and an outlet tank coupled to said heat exchange conduits and said bypass conduits and configured to receive the first fluid therefrom;

wherein said inlet section is configured to adjustably distribute the first fluid between said bypass section and said heat exchange section.

11. The integrated heat exchange and fluid control device of claim 10, wherein an airflow direction is defined as being substantially perpendicular to said heat exchange section and said bypass section, said blocking shield being oriented substantially perpendicular to said airflow direction.

12. The integrated heat exchange and fluid control device of claim 10, wherein said at least one blocking shield is moveably mounted with respect to said bypass section in order to control heat exchange between the first fluid located in said bypass section and a second fluid.

13. The integrated heat exchange and fluid control device of claim 12, wherein said at least one blacking shield is moveably mounted via a pivoting mechanism permitting said at least one blocking shield to pivotally move with respect to said bypass section.

14. The integrated heat exchange and fluid control device of claim 12, wherein said inlet section does not restrict flow of said first fluid into said bypass conduits.

15. The integrated heat exchange and fluid control device of claim 10, wherein said outlet tank including a partition therein substantially preventing mixing of the first fluid received from said bypass section and the first fluid received from said heat exchange section.

16. An engine cooling system for a motor vehicle, comprising:

a pump;

an engine having coolant passages in fluid communication with said pump; and an integrated radiator and coolant control device in fluid communication with both said engine and said pump and including:

an inlet section configured to receive liquid coolant into said integrated heat exchange and fluid control device;

a heat exchange section having a plurality of substantially parallel heat exchange conduits in fluid communication with said inlet section and configured to receive said liquid coolant therefrom and to permit substantial heat exchange between said liquid coolant located therein and an airflow defined across said heat exchange section;

a bypass section having at least one bypass conduit in fluid communication with said inlet section and configured to receive said liquid coolant therefrom and to substantially prevent heat exchange between said liquid coolant located in said bypass section and said airflow; and said bypass section is positioned parallel with said heat exchange conduits and located proximal to the top face or the bottom face; and an outlet section coupled to said heat exchange section and said bypass section configured to receive said liquid coolant therefrom, wherein said inlet section includes a device configured to adjustably distribute the first fluid between said bypass section and said heat exchange section.

* * * * *

UNITED STATES PATENT AND TRADEMARK OFFICE

CERTIFICATE OF CORRECTION

PATENT NO. : 6,997,143 B2
APPLICATION NO. : 10/734833
DATED : February 14, 2006
INVENTOR(S) : Davide F. Piccirilli et al.

It is certified that error appears in the above-identified patent and that said Letters Patent is hereby corrected as shown below:

Columns 6-7, in claim 2, line 3, after "inlet body" delete "arid" and substitute --and-- in its place.

Column 8, in claim 16, line 29, after "coolant therefrom" delete "," (comma) and substitute --;-- (semicolon) in its place.

Signed and Sealed this

Twenty-sixth Day of December, 2006

JON W. DUDAS
*Director of the United States Patent and Trademark Office*